United States Patent [19]

Faryna et al.

[11] 4,333,889

[45] Jun. 8, 1982

[54] CARBURETOR VACUUM BREAK ASSEMBLY

[75] Inventors: Myron Faryna; Kerry A. Morphet, both of Rochester, N.Y.

[73] Assignee: General Motors Corporation, Detroit, Mich.

[21] Appl. No.: 252,842

[22] Filed: Apr. 10, 1981

[51] Int. Cl.[3] ..... F02M 1/14

[52] U.S. Cl. ..... 261/39 B; 92/13.2; 92/13.6

[58] Field of Search ..... 261/39 B; 92/13.2, 13.6

[56] References Cited

U.S. PATENT DOCUMENTS

| | | | |
|---|---|---|---|
| 2,368,791 | 2/1945 | Waldie | 92/13.6 |
| 2,849,159 | 8/1958 | Kaufmann | 92/13.2 |
| 3,529,908 | 9/1970 | Smith | 92/13.2 |
| 3,606,983 | 9/1971 | Mitchell | 261/39 B |
| 3,685,809 | 8/1972 | Manning | 261/39 B |
| 3,852,383 | 12/1974 | Seaman | 261/69 R |
| 3,911,061 | 10/1975 | Obermeyer, Jr. et al. | 261/39 B |
| 3,928,511 | 12/1975 | Atsumi et al. | 261/64 C |
| 4,033,232 | 7/1977 | Benjamin et al. | 92/13.2 |
| 4,098,459 | 7/1978 | Benjamin | 261/39 B |

FOREIGN PATENT DOCUMENTS

| | | | |
|---|---|---|---|
| 985095 | 3/1976 | Canada | 92/13.2 |

*Primary Examiner*—Tim R. Miles

*Attorney, Agent, or Firm*—C. K. Veenstra

[57] ABSTRACT

A carburetor vacuum break assembly includes a telescopically constructed adjustable stop which permits adjustment of the carburetor choke vacuum break position but does not require an elongated sealing region about the stop.

1 Claim, 1 Drawing Figure

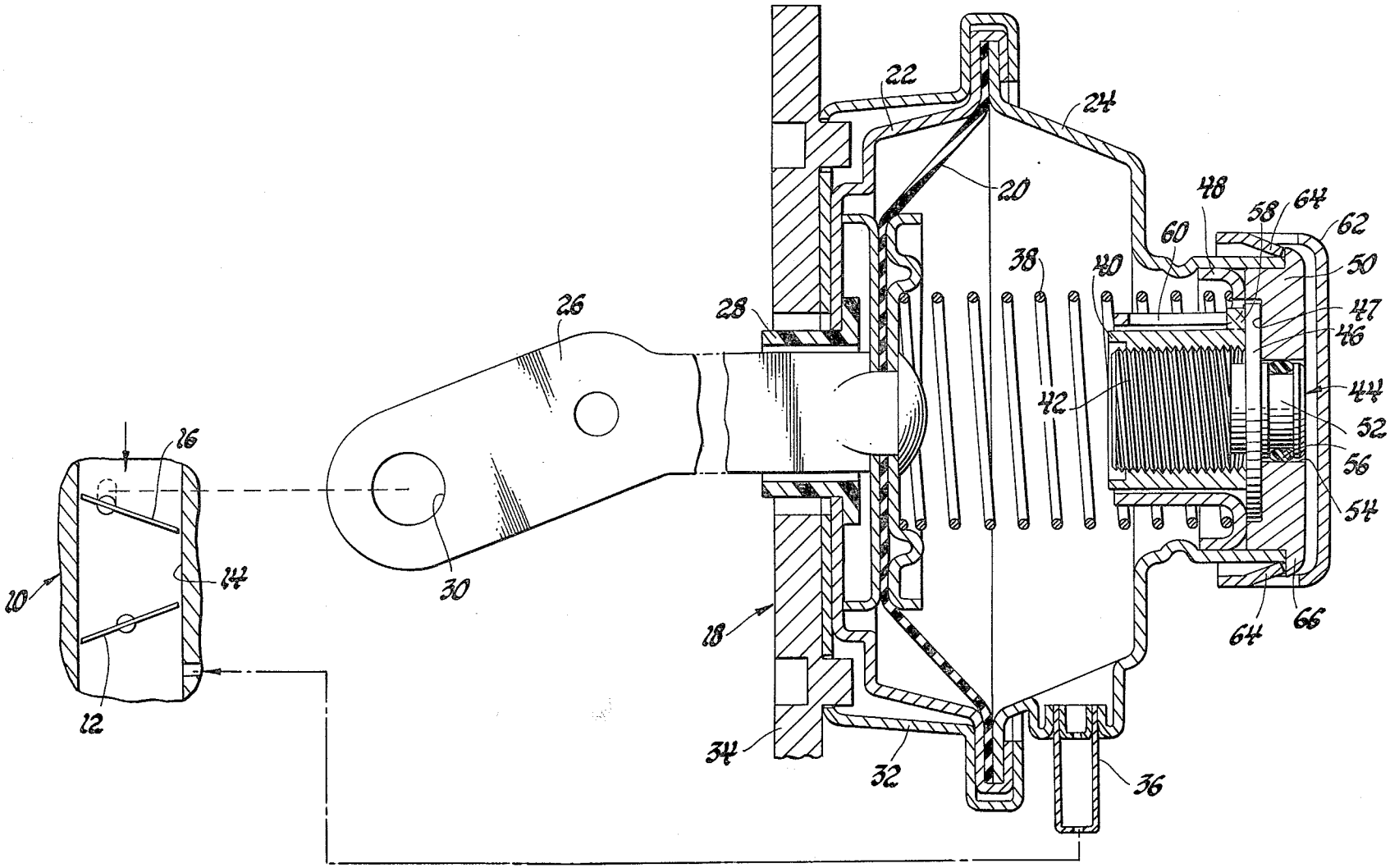
62
50
47
46
44
52
56
54
64
58
66
64
48
60
40
42
38
24
20
22
36
32
28
18
34
26
30
14
16
12
10

CARBURETOR VACUUM BREAK ASSEMBLY

TECHNICAL FIELD

This invention relates to a vacuum break assembly for positioning a carburetor choke blade and, more particularly, to such an assembly which has an improved adjustable stop.

BACKGROUND

Automotive engine carburetors conventionally include a vacuum break assembly which opens the carburetor choke blade to a vacuum break position after the engine is started. The vacuum break assembly includes a diaphragm which responds to engine vacuum and, when engine vacuum increases after the engine is started, pulls the choke blade to the vacuum break position.

Some vacuum break assemblies include an adjusting screw which limits the travel of the diaphragm in response to the increase in engine vacuum. The screw provides a stop for the diaphragm and is adjusted to establish the vacuum break position of the choke blade.

It will be appreciated that such an assembly should be sealed against air leaks which might otherwise disturb the engine vacuum signal which operates the vacuum break assembly. Thus in previous constructions, the adjusting screw was sealed by an O-ring, and an elongated sealing surface was required to maintain a seal about the screw over its range of adjustment.

SUMMARY OF THE INVENTION

This invention provides a vacuum break assembly which includes an improved stop to limit travel of the vacuum break diaphragm; the stop is adjustable to establish the choke blade vacuum break position and is constructed so that its seal does not require an elongated surface to maintain a seal over the range of adjustment.

In this invention, the adjustable stop includes a telescoping stem and bushing construction. The bushing moves axially to limit the travel of the vacuum break diaphragm, while the stem merely rotates to drive the bushing. The stem has a neck provided with a seal to prevent air leaks about the stop, and since the stem does not move axially, the sealing surface need not be elongated to maintain a seal over the range of adjustment.

Thus with this invention, the space required for the vacuum break assembly is shortened by an amount which would otherwise be necessary to maintain a seal over the range of adjustment of the stop.

The details as well as other features and advantages of this invention are set forth in the remainder of the specification and are shown in the accompanying drawing.

SUMMARY OF THE DRAWING

The sole FIGURE of the drawing is a sectional view of a carburetor vacuum break assembly including a preferred embodiment of this invention.

BEST MODE FOR CARRYING OUT THE INVENTION

Referring to the drawing, a carburetor schematically indicated at 10 includes a throttle 12 controlling flow through an air induction passage 14. A choke blade 16 is disposed in air induction passage 14 and is positioned by the combined influences of air flow through induction passage 14, a thermostatic member (not shown) and a vacuum break assembly 18.

Vacuum break assembly 18 includes a diaphragm 20 clamped between front and rear housing members 22 and 24. A stem 26 is secured to diaphragm 20 and extends through a nylon guide 28 which is staked in front housing member 22. Stem 26 includes an aperture 30 adapted to receive a link connected in any suitable manner to choke blade 16.

Vacuum break assembly 18 is mounted by a cover 32 on a bracket 34 which may be mounted on carburetor 10.

Rear housing member 24 carries a restricted vacuum fitting 36 which senses the manifold vacuum created in induction passage 14 downstream of throttle 12. As the engine is started, the increased vacuum (decreased pressure) sensed through fitting 36 pulls the center section of diaphragm 20 rightwardly, against the bias of a spring 38, to a retracted position in which it engages the end of a bushing 40.

Bushing 40 is threaded on the stem 42 of a screw member 44. Screw member 44 has a radially extending flange 46 which is trapped in a recess 47 between a housing insert member 48 and a housing plug member 50. Screw member 44 also has a neck 52 received in a bore 54 formed in housing plug member 50. The opening between neck 52 and bore 54 is sealed by an O-ring 56.

Flange 46 restrains screw member 44 against axial movement. Thus rotation of screw member 44 is transmitted to bushing 40. Bushing 40 includes a tab 58 which extends radially into an axially extending recess or slot 60 formed in housing insert member 48. Bushing 40 is thereby restrained against rotary motion, and rotation of screw member 44 is accordingly translated into axial movement of bushing 40. Thus by rotation of screw member 44, bushing 40 may be adjusted to establish the position to which the center section of diaphragm 20 is retracted.

After adjustment of screw member 44, a cap 62 is positioned over housing plug member 50. Cap 62 has barbs 64 lanced inwardly to snap over and engage a lip 66 on housing plug member 50. Removal of cap 62 and tampering with the adjustment of screw member 44 is thereby inhibited.

It will be noted that, since flange 46 restrains screw member 44 against axial movement, there is no axial movement of neck 52 in bore 54. Thus O-ring 56 does not move axially in bore 54, and neck 52 does not move axially in O-ring 56, so the sealing surfaces of neck 52 and bore 54 need not be elongated.

The embodiments of the invention in which an exclusive property or privilege is claimed are defined as follows:

1. A carburetor vacuum break assembly including a housing, a diaphragm secured in said housing and having a center section adapted to travel to and from a retracted position in response to variations in pressure in said housing, and a stop having a portion engaging said diaphragm in said retracted position, and wherein said stop comprises a screw member having a neck received in a bore in said housing, a radially extending flange trapped against axial movement in a radially extending recess in said housing, and a threaded stem projecting toward said diaphragm, a seal engaged between the neck of said screw member and said housing to prevent leakage about said screw member, and a bushing threaded on the stem of said screw member, said bushing having a tab extending radially into an axially extending recess formed in said housing whereby said bushing is trapped against rotary motion and is constrained to move axially upon rotation of said screw member, said bushing constituting said portion of said stop engaging said diaphragm in said retracted position, the position of said bushing being adjustable by rotation of said screw member to thereby establish said retracted position.

* * * * *